United States Patent [19]

Greig

[11] Patent Number: 4,881,856

[45] Date of Patent: Nov. 21, 1989

[54] CHIP SNAKE

[76] Inventor: Randall K. Greig, 936 Cascade Dr., Longview, Wash. 98632

[21] Appl. No.: 104,426

[22] Filed: Oct. 5, 1987

[51] Int. Cl.[4] ..... B65G 53/40

[52] U.S. Cl. ..... 406/134; 406/137; 239/143; 239/229

[58] Field of Search ..... 406/134, 135, 136, 137, 406/142, 109, 51, 73; 222/195, 228, 226, 404, 406, 407; 239/654, 143, 288.3, 229

[56] References Cited

U.S. PATENT DOCUMENTS

| | | | |
|---|---|---|---|
| 1,466,247 | 8/1923 | Pickop | 239/143 |
| 2,213,627 | 9/1940 | De Baugh | 134/167 R |
| 2,532,238 | 11/1950 | Malke | 222/406 |
| 2,601,655 | 6/1952 | Young | 239/229 |
| 3,166,222 | 1/1965 | Schrader | 406/137 X |
| 3,433,237 | 3/1969 | Gelinas | 134/168 R |
| 3,777,912 | 12/1973 | Deeks | 406/137 |
| 3,942,689 | 3/1976 | Dakin, Jr. et al. | 222/195 |
| 4,281,995 | 8/1981 | Pansini | 440/38 |
| 4,282,893 | 8/1981 | Kane | 134/167 R |
| 4,571,138 | 2/1986 | Farajun | 414/323 |

FOREIGN PATENT DOCUMENTS

| | | | |
|---|---|---|---|
| 957660 | 11/1974 | Canada | 222/195 |

*Primary Examiner*—Sherman D. Basinger
*Assistant Examiner*—Paul E. Salmon
*Attorney, Agent, or Firm*—Dellett, Smith-Hill & Bedell

[57] ABSTRACT

A device for cleaning impacted material, such as wood chips in silos, utilizing a raking action of regularly spaced spikes and a flailing action of a hose with a jet stream nozzle. The device comprises a hose, connectable at a proximal end to a compressed air supply, and a nozzle connectable to a distal end of the hose, the compressed air being forced through the hose and out the nozzle to cause the nozzle and the hose to move under the influence of the expulsion of compressed air at the distal end of the hose. The spikes are attached along the hose to provide regularly spaced raking elements, and anti-kink mechanisms urge the hose into straight alignment. In operation, the nozzle is lowered into a silo in the vicinity of impacted material. Then compressed air is introduced into the hose and expelled out the nozzle in a jet stream thereby causing the hose and nozzle to undulate within the silo such that the spikes strike and dislodge the impacted material.

20 Claims, 3 Drawing Sheets

CHIP SNAKE

BACKGROUND OF THE INVENTION

The present invention relates generally to silo cleaning devices and particularly to devices for dislodging impacted material in silos.

Wood products, such as saw dust and wood chips, are typically loaded into the top of a silo by an overhead conveyer and removed by a chain conveyer, plate feeder, or star feeder at the bottom of the chip mass or through an opening at the bottom of the silo. The wood products in storage thus pass from the top to the bottom as the silo is emptied. Often the wood chips or sawdust become impacted and form bridges which block their passage, preventing the emptying of the silo. The wood chips forming such bridges are usually either inaccessible from below the chip mass or too dangerous to dislodge from below, and it is therefore desirable to dislodge such bridges from above.

SUMMARY OF THE INVENTION

According to one aspect of the present invention, a flexible hose is connected at a first end to a compressed air source to provide compressed air to an air nozzle at a second end of the hose, the compressed air being expelled from the nozzle and causing the hose and nozzle to flail about. Spikes, provided along the length of the hose and at the nozzle, extend radially from the hose and nozzle to provide raking elements for striking and dislodging impacted material in a silo when the nozzle and hose are lowered into the silo and the compressed air is introduced into the first end of the hose.

According to a second aspect of the present invention, the hose and nozzle and the size of the nozzle outlet are such that a commonly available amount of air pressure is sufficient to operate the device, there being no need to provide a special high pressure compressed air supply.

In a third aspect, the present invention provides a method of dislodging impacted wood chips in a silo in a safe manner, i.e., from above the chip mass.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements.

DRAWINGS

DETAILED DESCRIPTION

Figure 1:
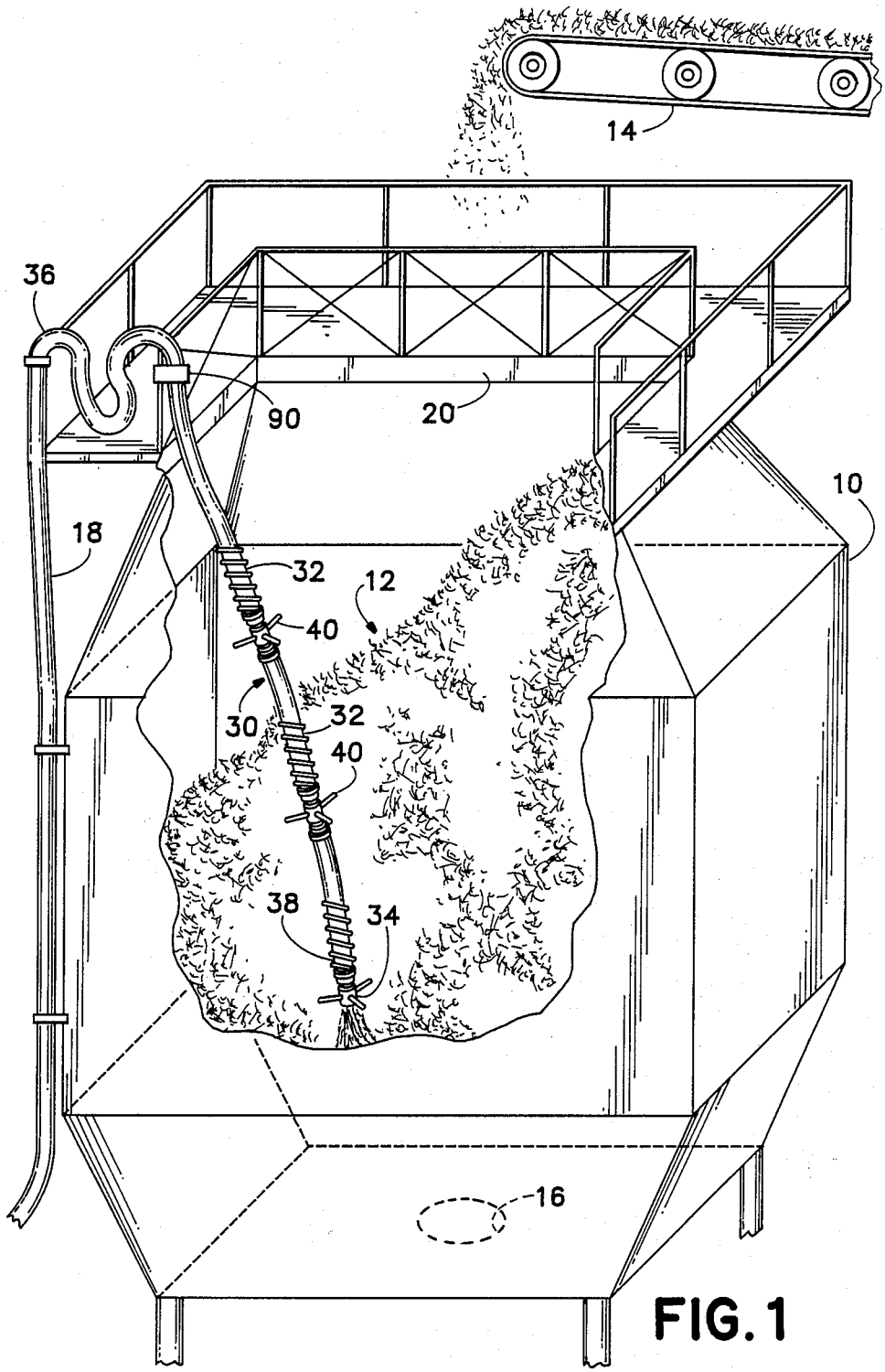
FIG. 1 is a cut away view of a silo and, in accordance with the present invention, a chip snake.

In FIG. 1, a silo 10 is used to store wood chips 12 wherein the chips 12 are placed in the silo 10 from above via a loading conveyer belt 14, and taken from the silo 10 from below, via a lower opening 16. The silo 10 is provided with a compressed air supply hose 18 and an upper opening 20 for overhead access to the chips 12 within the silo 10.

A chip snake 30 according to the present invention is used from above the silo 10 to dislodge impacted wood chips 12 within the silo, the chip snake 30 including a hose 32 and an air nozzle head 34 wherein a proximal end 36 of the hose 32 is connectable to the air supply hose 18 and a distal end 38 of the hose 32 is coupled to nozzle head 34. The distal end 38 and the nozzle head 34 of the chip snake 30 are lowered through the upper silo opening 20 and positioned in the vicinity of impacted chips 12 forming chip bridges. When the proximal end 36 of hose 32 is coupled to the air supply hose 18, compressed air from the supply hose 18 can be directed through the hose 32 and expelled from the nozzle head 34 in a jet stream to cause the hose 32 and nozzle head 34 to flail about the silo in an undulating manner in the vicinity of the impacted material. A plurality of spikes 40, extending radially from the hose 32 at regularly spaced intervals and extending from the nozzle head 34, strike and dislodge the impacted chips with a raking action.

Figure 2:
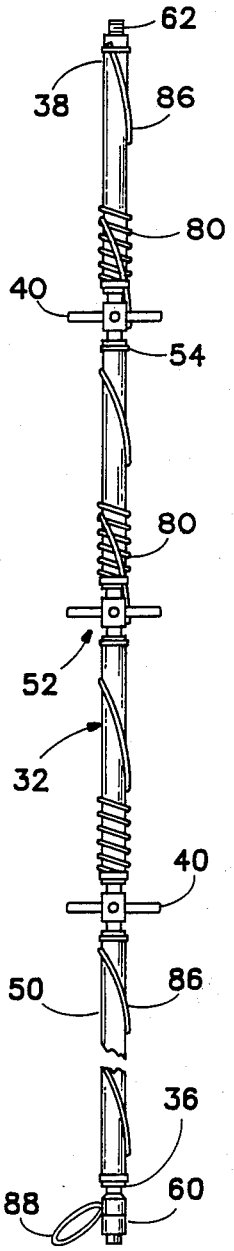
FIG. 2 is a detailed view of a hose utilized in the chip snake of FIG. 1.
Figure 3:
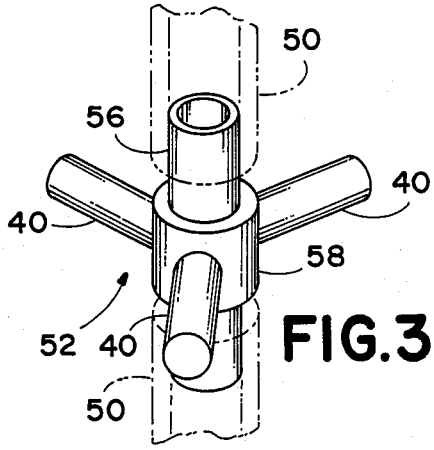
FIG. 3 is a perspective view of a spike joint used in the chip snake of FIG. 1.

Referring now to FIG. 2, the hose 32 includes a plurality of flexible hose segments 50 in end-to-end relation, spike joints 52 coupling adjacent hose segments 50, with circular clamps 54 securing the spike joints 52 within ends of the hose segments. As seen in FIG. 3, each of the spike joints 52 includes an interconnect pipe 56, a collar 58, and spikes 40. The interconnect pipes 56 are adapted to be inserted longitudinally at the ends of hose segments 50 while the clamps 54 secure the interconnect pipes 56 within the segments 50. Each collar 58 is welded concentrically to the exterior of one interconnect pipe 56 and three of the spikes 40 are suitably welded to each collar 58, with the spikes 40 extending radially therefrom and being equiangularly spaced thereabout. The proximal end 36 of the hose 32 includes a male locking air fitting 60 for connection to the air supply hose 18 while the distal end 38 of the hose 32 includes a threaded nozzle attachment 62. Compressed air introduced at the fitting 60 is communicated through the assembly of hose segments 50 and interconnect pipes 52, through the nozzle attachment 62, and delivered to the nozzle head 34 threaded onto nozzle attachment 62.

Figure 5:
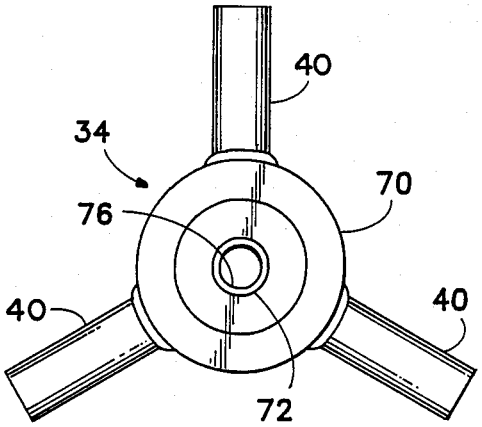
FIG. 5 is a top view of the nozzle of FIG. 4.
Figure 4:
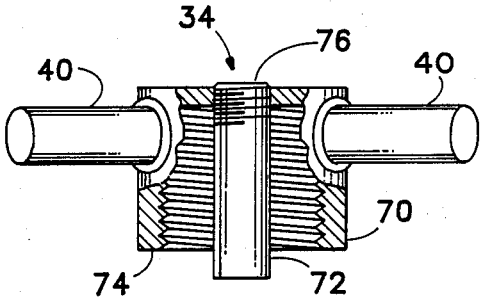
FIG. 4 is a cut away side view of a nozzle utilized in the chip snake of FIG. 1.

In FIGS. 4 and 5, the illustrated nozzle head 34 comprises a cylindrical cap 70 and a threaded expulsion pipe 72, the cap 70 having an internally threaded first end 74 and a threaded outlet aperture 76 at the opposite end, wherein end 74 is threaded onto nozzle attachment 62 and expulsion pipe 72 extends through the cap and is threaded into outlet aperture 76. The expulsion pipe 72 and outlet aperture 76 have smaller interior diameters than the interior diameters of the cap 70 and the hose 32. The compressed air delivered by way of the hose 32 to the cap 70 then increases in velocity as it is expelled from the chip snake through the relatively smaller diameter expulsion pipe, the expulsion of compressed air forming a jetstream causing the chip snake to flail within silo 10. Expulsion pipe 72 is mounted internally of cap 70 to protect it from damage during chip snake operation. Affixed externally of the cap 70, extending radially therefrom and equiangularly spaced therearound, are spikes 40.

It has been found that while flailing within a silo, the hose 32 may tend to kink, or double-back on itself, and become tangled in the spikes 40, thereby reducing the efficiency of the chip snake. This problem is solved by means of anti-kink springs 80 positioned longitudinally about the hose 32, one end of each of the springs 80 being affixed to the hose 32 by one of the clamps 54. The springs 80 provide radial pressure in the vicinity of the spikes 40 for urging the hose 32 toward straight alignment. The springs 80 exert no radial force when the hose 32 is in straight alignment, but as the hose moves under the influence of the expelled air, the spring 80 opposes bending with sufficient force to allow the hose 32 to bend to some degree but not to such a degree that kinking takes place. Advantageously, the anti-kink springs 80 enhance the "snap" of the chip snake.

A safety cable 86 extends from the proximal end 36 of the hose 32 to the distal end 38 thereof and is secured therealong by the clamps 54. A loop 88 in the cable is provided at the proximal end 36 of the hose 32 as a means for attaching a safety clip to the hose 32. In the event that one of the hose segments 50 is broken during operation of the chip snake 30, the cable 86 secures the detached portion of the chip snake for recovery from the silo. The chip snake may then be repaired by replacement of the broken hose segment.

Returning now to FIG. 1 for a description of overall operation, the chip snake 30 may be operated by one person from the top of the silo 10. When a chip bridge is detected in the silo 10, the operator lowers the nozzle head 34 and the distal end 38 of the hose 32 in the silo 10 through opening 20. The nozzle head 34 is positioned by the operator near the chip bridge and the hose 32 is secured to the silo 10 by a clamp 90 so as to maintain a minimum length of the hose 32 within the silo 10 while still reaching the chip bridge. After the hose 32 is secured to the silo 10, the air fitting 60 at the proximal end 36 of the hose 32 is coupled to the compressed air supply hose 18 and the air supply is turned on by means not shown. As the compressed air escapes through the hose 32 and out the nozzle head 34, the chip snake 30 is caused to flail about under the influence of the jet stream of air expelled from the nozzle head 34. As the chip snake 30 flails about, the spikes 40 strike and dislodge the wood chips 12 forming the chip bridge.

For safety reasons, the chip snake should always be well secured to the silo 10, with an appropriate amount of the hose 32 hanging down in the silo 10 before any compressed air is introduced into the hose 32.

The action of the chip snake 30 is somewhat dependent on the weight of the components and the amount of air pressure used. Advantageously, in the embodiment described herein, the weight of components are such that a commonly available air pressure, approximately 90 psi, is sufficient to operate the chip snake. The air pressure requirements will increase where heavier components are used or where the silo is exceptionally high. In the preferred embodiment, the hose segments 50, sold under the brand name "Goodyear ¾ inch Gorilla Hose", are ¾ inches in interior diameter and 14 inches in length between spike joints 52, and the interconnect pipes 56 are ¾ inches in exterior diameter and 4 inches in length. The spikes 40 affixed at the nozzle head 34 may be of different dimension than the spikes 40 attached along the length of the hose 32. The spikes 40 affixed at the nozzle head are preferably round stock ⅛ inch in diameter and 1 inch in length and the spikes 40 attached along the length of the hose 32 are preferably round stock ⅛ inch in diameter and 2 inches in length. The ends of the spikes are suitably squared off as illustrated.

Figure 6:
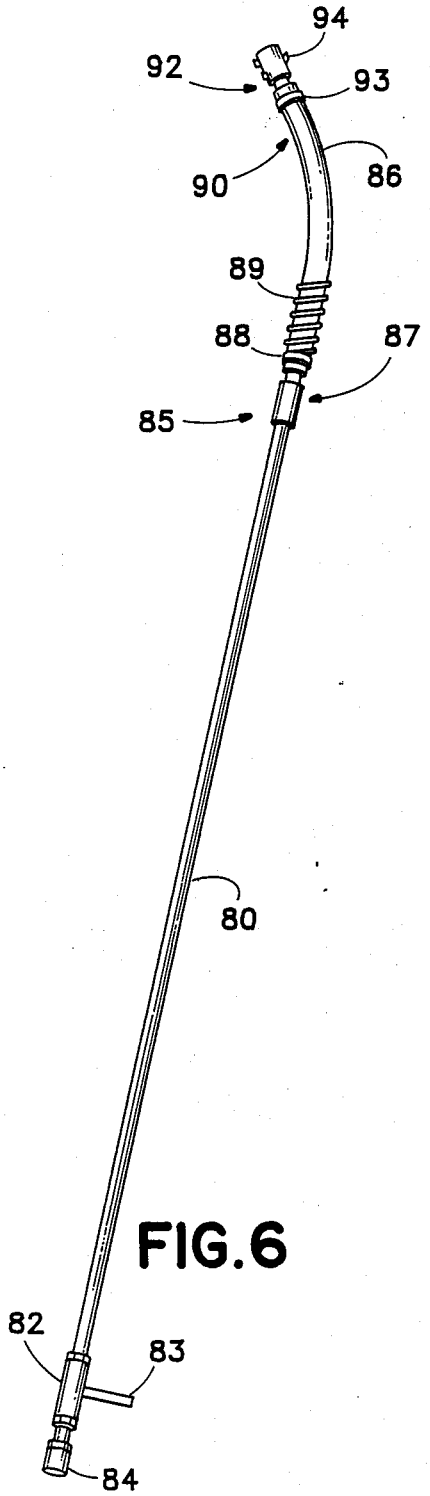
FIG. 6 is a perspective view of a second embodiment of the present invention.
Figure 8:
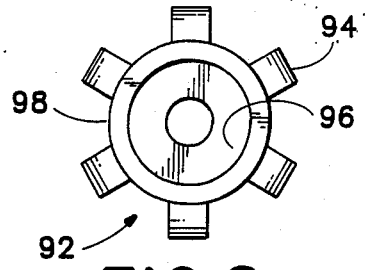
FIG. 8 is an end view of the nozzle head of FIG. 7 taken at 8—8 in FIG. 7.
Figure 7:
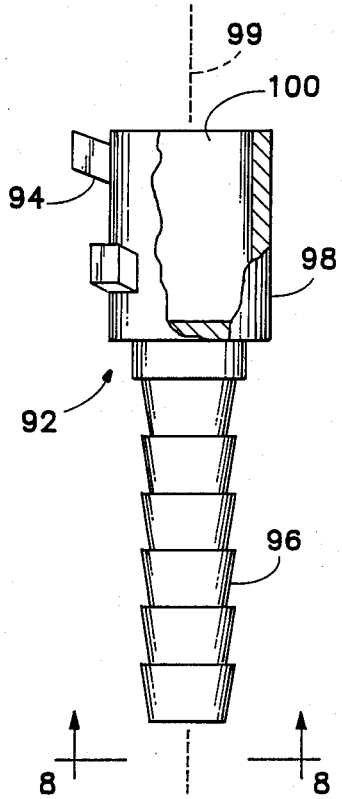
FIG. 7 is a side view partially cut away of a nozzle head used in the embodiment of FIG. 6.

Referring to FIGS. 6, 7 and 8, a second embodiment of the present invention includes a rigid tube 80, the tube 80 having at a first end an air valve 82, operable by means of handle 83 to control the flow of compressed air through the tube 80, and an air fitting 84 for connection to an air supply hose (not shown) for introducing compressed air into the tube 80. At a second end 85 of the tube, a flexible hose 86 is attached at its proximal end 87 by a clamp 88, the clamp 88 also securing an anti-kink spring 89 surrounding the proximal end 87 of the hose 86 for preventing the hose 86 from doubling back or kinking at proximal end 87. At a distal end 90 of the hose 86, a nozzle head 92 is secured by clamp 93, the nozzle head 92 having spikes 94 extending radially outwardly therefrom for striking and dislodging impacted material. The nozzle head 92 includes a lower, tapered, tubular ribbed section 96 adapted for insertion into the distal end 90 of the hose 86, and an upper tubular section 98 whereat the spikes 94 are affixed. Compressed air introduced into ribbed section 96 from the hose 86 flows into the upper section 98 and escapes the nozzle head 92 through upper opening 100 therein.

The spikes 94 are formed from key stock having a square cross section, the spikes 94 being cut angularly at each end and disposed obliquely with respect to a longitudinal axis 99 of the nozzle head 92. The hose 86 is preferably of the type sold under the brand name "Goodyear ¾ inch Gorilla Hose" and is approximately 14 inches in length. The tube 80 may comprise a section of aluminum tubing up to 25 feet in length and ¾ inches in interior cross sectional diameter. The diameter of the opening 100 in the nozzle head 92 is suitably ¾ inch. In the second embodiment, an air pressure of 90 to 120 psi is sufficient to operate the chip snake. Again, air pressure requirements will vary depending on component dimensions and weight.

In operation of the second embodiment of the present invention, the tube 80 may be hand held by an operator or secured to a silo by clamping means. Compressed air introduced into the tube 80 by way of the fitting 84 is communicated, when the valve 82 is open, through the tube 80 and the hose 86 to escape from the nozzle head 92 thereby causing the hose 86 to flail about in an undulating fashion under the influence of the escaping air. Advantageously, the described second embodiment allows an operator to direct more accurately the action of the nozzle head in the area of impacted material. Further, the described second embodiment may be operated from below the chip mass in that the rigid tube 80 may be used to support the hose 86 and nozzle head 92 in a raised position relative to the operator.

While a preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

I claim:

1. A device for dislodging impacted material comprising:

a flexible hose having a first end and a second end, the first end being adapted for coupling to a source of compressed air such that compressed air may be introduced into said hose at the first end and delivered at the second end thereof, wherein the hose comprises a plurality of hose segments disposed in end-to-end relationship and a plurality of interconnect pipes coupling ones of said plurality of hose segments, said interconnected pipes being joined to adjacent ends of said hose segments, and air nozzle means attached to the second end of said hose for expelling compressed air therefrom causing said device to undulate under the influence of the expulsion of compressed air, said undulation of said device being effective to cause said device to strike and dislodge said impacted material.

2. A device in accordance with claim 1, including means securing said interconnect pipes to said hose segments, wherein said securing means comprise a plurality of circular clamps positioned at said ends of said hose segments.

3. A device in accordance with claim 2, wherein said securing means further comprises a cable extending from the first end of said hose to the second end of said hose, the cable being secured at the ends of said hose segments by said circular clamps.

4. A device in accordance with claim 1, wherein a first end of one of said plurality of hose segments constitutes the first end of said hose and a second end of another one of said plurality of hose segments constitutes the second end of said hose, the first end including an air fitting for coupling to a compressed air supply and the second end being adapted to receive said air nozzle means.

5. A device in accordance with claim 1, wherein the device further includes raking elements attached to said interconnect pipes for striking and dislodging said impacted material.

6. A device in accordance with claim 5, wherein said raking elements comprise spikes attached to said interconnect pipes and extending radially therefrom for striking and dislodging said impacted material.

7. A device in accordance with claim 1, wherein the device further comprises anti-kinking means for preventing said device from doubling back on itself.

8. A device in accordance with claim 7, wherein said anti-kinking means comprises a plurality of springs positioned longitudinally upon said hose segments and providing radial forces for tending to straighten said hose.

9. A device in accordance with claim 1, wherein said device further comprises means for positioning said device in the vicinity of said impacted material.

10. A device in accordance with claim 9, wherein said means for positioning comprises a clamp.

11. A device for dislodging impacted material comprising:

a flexible hose having a first end and a second end, the first end being adapted for coupling to a source of compressed air such that compressed air may be introduced into said hose at the first end and delivered at the second end thereof, wherein the hose comprises a plurality of hose segments disposed in end-to-end relationship, and a plurality of interconnect pipes coupling ones of said plurality of hose segments, said interconnect pipes being joined to adjacent ends of said hose segments;

air nozzle means attached to the second end of said hose for expelling compressed air therefrom causing said device to undulate under the influence of the expulsion of compressed air;

raking elements joined to said hose for striking and dislodging said impacted material; and said undulation of said device being effective to cause said device to strike and dislodge said impacted material.

12. A device in accordance with claim 11, including means securing said interconnect pipes to said hose segments, wherein said securing means comprise a plurality of circular clamps positioned at said ends of said hose segments.

13. A device in accordance with claim 12, wherein said securing means further comprises a cable extending from the first end of said hose to the second end of said hose, the cable being secured at the ends of said hose segments by said circular clamps.

14. A device in accordance with claim 11, wherein a first end of one of said plurality of hose segments constitutes the first end of said hose and a second end of another one of said plurality of hose segments constitutes the second end of said hose, the first end including an air fitting for coupling to a compressed air supply and the second end being adapted to receive said air nozzle means.

15. A device in accordance with claim 11, wherein said raking elements comprise spikes attached to said interconnect pipes and extending radially therefrom for striking and dislodging said impacted material.

16. A device for dislodging impacted material comprising:

a flexible hose having a first end and a second end, the first end being adapted for coupling to a source of compressed air such that compressed air may be introduced into said hose at the first end and delivered at the second end thereof, wherein the hose comprises a plurality of hose segments disposed in end-to-end relationship, and a plurality of interconnect pipes coupling ones of said plurality of hose segments, said interconnect pipes being joined to adjacent ends of said hose segments;

air nozzle means attached to the second end of said hose for expelling compressed air therefrom causing said device to undulate under the influence of the expulsion of compressed air;

means for positioning said device in the vicinity of said impacted material; and said undulation of said device being effective to cause said device to strike and dislodge said impacted material.

17. A device in accordance with claim 16, including means securing said interconnect pipes to said hose segments, wherein said securing means comprise a plurality of circular clamps positioned at said ends of said hose segments.

18. A device in accordance with claim 17, wherein said securing means further comprises a cable extending from the first end of said hose to the second end of said hose, the cable being secured at the ends of said hose segments by said circular clamps.

19. A device in accordance with claim 16, wherein a first end of one of said plurality of hose segments constitutes the first end of said hose and a second end of another one of said plurality of hose segments constitutes the second end of said hose, the first end including an air fitting for coupling to a compressed air supply and the second end being adapted to receive said air nozzle means.

20. A device in accordance with claim 16, wherein the device further includes raking elements attached to said interconnect pipes for striking and dislodging said impacted material.

* * * * *